US008857346B2

(12) United States Patent
Khanjian et al.

(10) Patent No.: US 8,857,346 B2
(45) Date of Patent: Oct. 14, 2014

(54) EASY PARTY TABLE

(76) Inventors: Cindy Khanjian, Cresskill, NJ (US); John Chiovetta, Saddle Brook, NJ (US)

( * ) Notice: Subject to any disclaimer, the term of this patent is extended or adjusted under 35 U.S.C. 154(b) by 58 days.

(21) Appl. No.: 13/364,227

(22) Filed: Feb. 1, 2012

(65) Prior Publication Data

US 2012/0204765 A1 Aug. 16, 2012

Related U.S. Application Data

(60) Provisional application No. 61/438,501, filed on Feb. 1, 2011.

(51) Int. Cl.

| | |
|---|---|
| ***A47B 31/02*** | (2006.01) |
| ***A47F 10/06*** | (2006.01) |
| ***A47B 3/087*** | (2006.01) |
| ***A47B 37/00*** | (2006.01) |
| *A47B 13/16* | (2006.01) |

(52) U.S. Cl.

CPC ..... *A47B 3/087* (2013.01); *A47F 10/06* (2013.01); *A47B 37/00* (2013.01); *A47B 13/16* (2013.01)

USPC ..... 108/26

(58) Field of Classification Search

USPC ..... 206/541, 542, 562; 220/629, 636, 628, 220/4.22, 4.21, 833–835, 212, 23.88, 23.89, 220/23.87; 62/258, 261, 371, 457.1, 459; 312/140.1–140.4, 126, 127, 229, 116; 108/24–26, 28, 50.13, 167, 168, 108/170–173, 175, 33–36, 38, 41, 14, 18, 108/90; 99/483, 449; 126/268, 33, 43, 261, 126/276

See application file for complete search history.

(56) References Cited

U.S. PATENT DOCUMENTS

| | | | | | |
|---|---|---|---|---|---|
| 46,491 | A * | 2/1865 | Patrick | 126/392.1 |
| 1,205,569 | A * | 11/1916 | Schwimmer | 219/430 |
| 1,800,863 | A * | 4/1931 | Johnson | 126/261 |
| 1,845,771 | A * | 2/1932 | Vaughan | 108/90 |
| 2,024,259 | A * | 12/1935 | Troeber et al. | 126/377.1 |
| 2,520,543 | A * | 8/1950 | Hawkins | 219/386 |
| 2,798,615 | A * | 7/1957 | Klappert et al. | 211/31 |
| 3,130,288 | A * | 4/1964 | Monaco et al. | 219/385 |
| 3,364,882 | A * | 1/1968 | Merrick | 108/25 |
| 3,602,926 | A * | 9/1971 | Marini et al. | 5/111 |
| 4,147,395 | A * | 4/1979 | Gale | 108/186 |
| 4,739,580 | A | 4/1988 | Simmons et al. | |
| D307,365 | S * | 4/1990 | Dry et al. | D6/429 |
| 4,920,873 | A * | 5/1990 | Stevens | 99/339 |
| 5,060,580 | A * | 10/1991 | Shaw | 108/25 |
| 5,778,802 | A * | 7/1998 | Hairston et al. | 108/90 |
| 6,267,111 | B1 | 7/2001 | Burton | |
| 6,591,831 | B2 * | 7/2003 | Reynolds | 126/33 |
| 7,779,762 | B2 * | 8/2010 | Sackman | 108/25 |
| 8,015,928 | B2 * | 9/2011 | Chen | 108/35 |
| 2002/0020304 | A1 * | 2/2002 | Reynolds | 99/339 |
| 2005/0150395 | A1 | 7/2005 | Olekaibe | |
| 2005/0274301 | A1 * | 12/2005 | Rattin et al. | 108/124 |
| 2007/0034200 | A1 | 2/2007 | Torre | |
| 2007/0056482 | A1 * | 3/2007 | Robinson et al. | 108/25 |
| 2011/0088974 | A1 * | 4/2011 | Bond | 182/129 |
| 2013/0068919 | A1 * | 3/2013 | Antonioni | 248/614 |

* cited by examiner

*Primary Examiner* — Janet M Wilkens

(74) *Attorney, Agent, or Firm* — Stuart J. West; Shaun Sluman; West & Associates, A PC

(57) ABSTRACT

A party table with bays capable of accepting interchangeable inserts for serving and storing food items. The party table can be folded for storage or transport. One or more attachments can be used with the inserts to heat, cool, or regulate the temperature of the food items in the inserts.

17 Claims, 10 Drawing Sheets

EASY PARTY TABLE

CROSS-REFERENCE TO RELATED APPLICATIONS

This application claims the benefit of priority to prior filed U.S. Provisional Patent Application No. 61/438,501, filed Feb. 1, 2011, the complete contents of which are hereby incorporated by reference.

BACKGROUND

1. Field of Invention

The present disclosure relates generally to food service tables, specifically a food service table that can be collapsed for storage and transport and that has interchangeable service components.

2. Background

Serving food and beverages to a large group of people can be a difficult task. Regular household cooking and serving equipment is often designed to prepare and serve food and beverages to only a relatively small number of people, and may not be suitable for serving food and beverages to large gatherings of people. Large gatherings can include barbeques, banquets, buffets, birthday parties, holiday parties, wedding receptions, graduation parties, anniversary parties, tailgating parties, and other events where large groups of people may need to be fed.

Caterers, commercial kitchens, and other commercial vendors can be accustomed to serving large gatherings of people at a single occasion, using equipment such as semi-permanent steam tables, salad bars, warming carts, and other devices. However, because these devices are often designed for large commercial industries such as restaurants, hotels, and resorts, they are often bulky, heavy, hard to move, and/or hard to store. Such commercial equipment is not designed for infrequent or occasional use, and cannot be quickly or easily broken down for storage and/or transport.

Folding tables, card tables, and other types of tables can be more easily stored and transported. However, food and/or beverages must be placed loose on top of the tables. This can lead to dishes being knocked off the table or becoming disorganized because the food trays are not secured to the table. There is also no built-in equipment to keep the food warm or cool on a standard table.

What is needed is a serving device that can be transported and/or assembled for commercial and/or residential use. The device can be used to serve food and/or beverages to a group of people, and then be disassembled for storage and/or transport. The device can be able to accommodate any selection of hot and/or cold foods, be light weight, and be durable. The device can also have interchangeable inserts for different uses or types of food, as well as equipment for heating and/or cooling the food.

DETAILED DESCRIPTION

Figure 1:
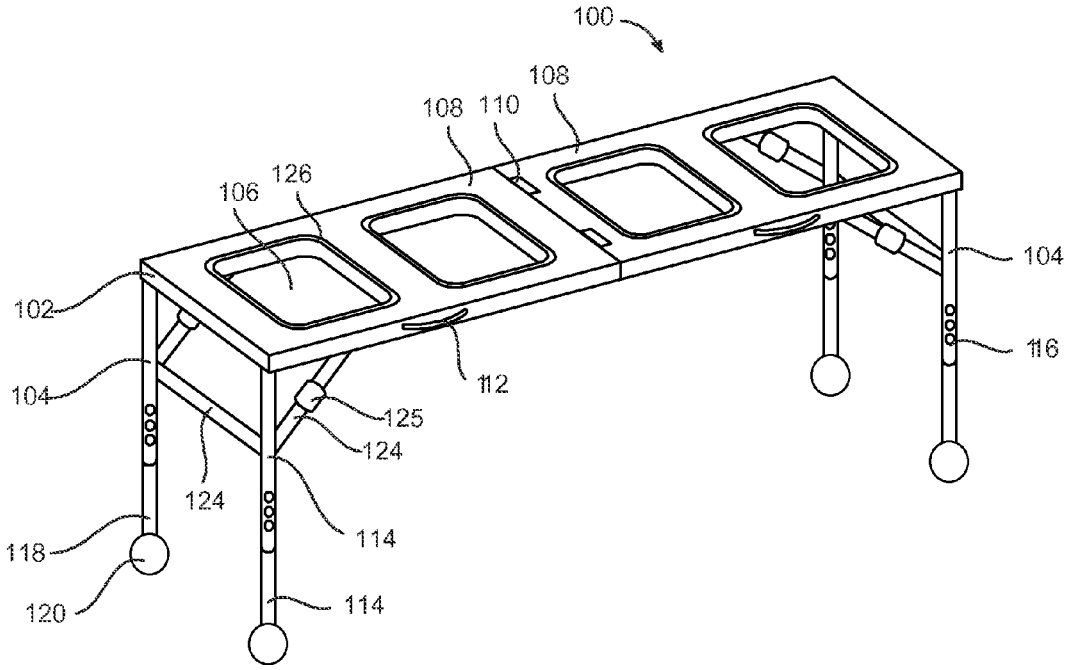
FIG. 1 depicts an isometric view of an embodiment of a party table.

FIG. 1 depicts an isometric view of an embodiment of a party table 100. The party table 100 can comprise a tabletop 102 and one or more legs 104. The tabletop 102 can further comprise one or more bays 106.

In some embodiments, the tabletop 102 can have a rectangular shape. In other embodiments, the tabletop 102 can be circular, ovoid, L-shaped, triangular, or be any other shape. In some embodiments, the tabletop 102 can be comprised of plastic. In other embodiments, the tabletop 102 can be comprised of wood, metal, carbon composite, glass, stone, or any other material or combination of materials. In some embodiments, the tabletop 102 can be comprised of a lightweight material. In other embodiments, the tabletop 102 can be comprised of a heavy duty material.

The tabletop 102 can be comprised of one or more table segments 108. In some embodiments, the tabletop 102 can be comprised of a single table segment 108. In other embodiments, the tabletop 102 can be comprised of a plurality of table segments 108 coupled with one another. In some embodiments, two or more table segments 108 can be hingeably coupled with one another such that the tabletop 108 can be folded about hinges 110. In some embodiments in which the tabletop 102 can be folded, the hinges 110 can be locked such that the tabletop 102 remains in an unfolded configuration and can be unlocked to fold the party table 100. In alternate embodiments, the table segments 108 can be leaves that can be added or removed from the party table 100 to expand or contract the surface area of the tabletop 102.

In some embodiments, the tabletop 102 can further comprise one or more handles 112. The handles 112 can be apertures within the tabletop 102, depressions into the tabletop 102, and/or extensions coupled with the tabletop 102. The handles 112 can be located on the edges of the tabletop 102, at the ends of the tabletop 102, or at any other location on the tabletop 102. In some embodiments, the handles 112 can be integral with the tabletop 102 and can be comprised of the same material as the tabletop 102. In other embodiments, the handles 102 can be separate components coupled with the tabletop 102 and can be comprised of plastic, fabric, wood, metal, or any other material or combination of material.

Each leg 104 can comprise one or more leg members 114 that together extend from the ground to the tabletop 102. The legs 104 can be coupled with the tabletop 102 at any position suitable to support and stabilize the tabletop 102 above the ground. In some embodiments, the legs 104 can be coupled with the bottom side of the tabletop 102. In alternate embodiments, the legs 104 can be coupled with the sides of the tabletop 102 or any other location on the tabletop 102. In some embodiments, a leg 104 can be provided at each corner of the tabletop 102. In other embodiments, legs 104 can be provided at each end of the tabletop 102, around the edges of the tabletop 102, at the corners of the tabletop 102, at the center of the tabletop 102, or at any other position on the tabletop 102 in any configuration. The leg members 114 can be comprised of aluminum, plastic, metal, wood, or any other material or combination of materials.

In some embodiments, each leg 104 can be comprised of a single leg member 114. In other embodiments, each leg 104 can be comprised of a plurality of leg members 114. Each of the plurality of leg members 114 can be straight, rounded, curved, and/or have any other shape. Each of the plurality of leg members 114 can be oriented vertically, horizontally, diagonally, or have any other orientation. In some embodiments in which the legs 104 comprise a plurality of leg members 114, two or more of the leg members 114 can be hingeably coupled with one another such that the leg 104 can be folded. In some embodiments, the legs can be locked into position and unlocked when a user desires to fold the legs 104.

In some embodiments, the height of the legs 104 can be adjusted in order to adjust the height of the party table 100. In some embodiments, the leg members 114 can be coupled with one another at one of a plurality of possible positions 116 to set the height of the leg 104. In alternate embodiments, the height of the legs 104 can be fixed.

Each leg 104 can have one or more feet 118 at the end of the leg 104 that is configured to meet the ground. In some embodiments, the feet 118 can be coupled with a non-skid material such as rubber. In other embodiments, the feet 118 can be coupled with wheels 120, such that the party table 100 can be transported by rolling the party table along the wheels 120. In some embodiments, the wheels 120 can be configured to lock into place, such that the party table 100 cannot be rolled along the wheels 120 when the wheels 120 are locked.

Figure 2A:
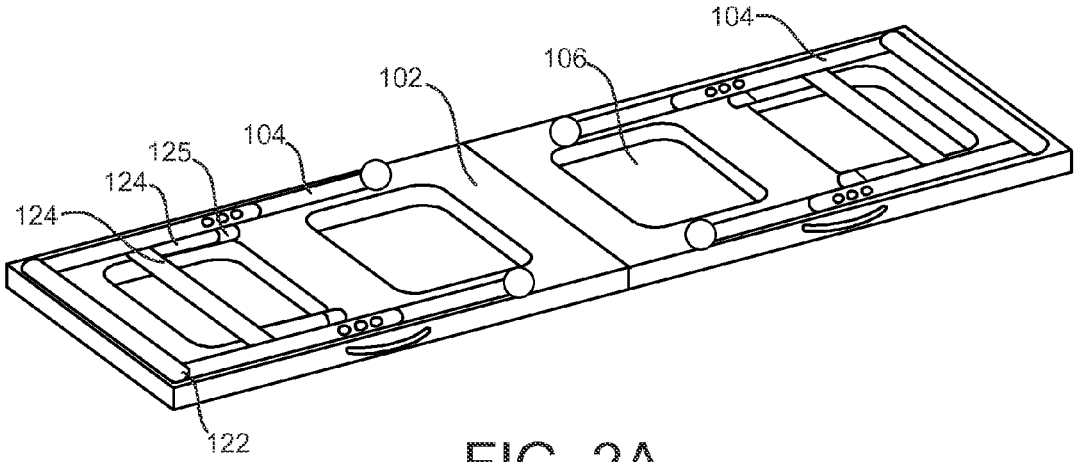
FIG. 2A depicts an isometric view of an embodiment of a party table in a storage configuration.
Figure 2B:
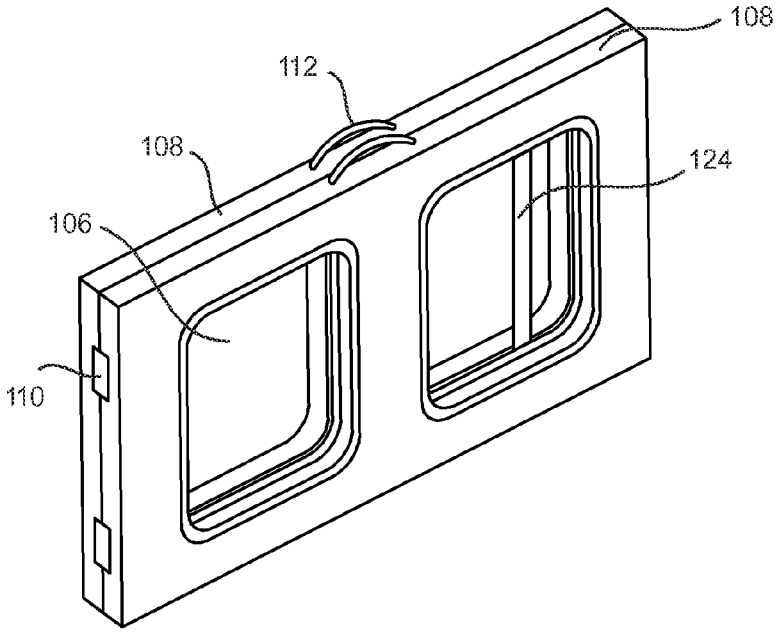
FIG. 2B depicts an isometric view of an embodiment of a party table in another storage configuration.

FIGS. 2A and 2B depicts embodiments of the party table 100 in storage configurations. In some embodiments, the legs 104 can be hingeably coupled with the tabletop 102 at point 122, such that the legs 104 can be moved between a standing configuration with the legs 104 substantially perpendicular to the tabletop 102 as shown in FIG. 1, and a storage configuration with the legs 104 substantially parallel to the table segments 108. By way of a non-limiting example, FIG. 2A depicts an embodiment in which the legs 104 and support members 124 are folded against the tabletop 102. By way of another non-limiting example, FIG. 2B depicts an embodiment in which the table segments 108 are folded about the hinges 110 and the legs 104 are folded against the table segments 108 such that the legs 104 are inside the folded party table 100. In alternate embodiments, the legs 104 can be outside the folded party table 100 when the table segments 108 are folded. In some embodiments, the legs 104 can be locked when the party table 100 is in the standing configuration and unlocked when a user desires to fold the legs 104 into the storage configuration. In alternate embodiments, the legs 104 can be selectively removable from the tabletop 102.

Referring back to FIG. 1, one or more support members 124 can be coupled with the tabletop 102 and/or the legs 104. In some embodiments, support members 124 can extend from a leg 104 to the underside of the tabletop 102 at an angle. In other embodiments, support members 124 can extend from one leg 104 to one or more different legs 104 along the underside of the tabletop 102 to form crossbars that can provide support to the tabletop 102. In still other embodiments, the support members 124 can extend from one leg 104 to one or more different legs 104 at a distance below the tabletop 102. In some embodiments, the support members 124 can be folded and/or locked in place with one or more brackets 125 and/or hinges. In some embodiments, the support members 124 can be hingeably coupled with the legs 104 and/or the tabletop 102. In some embodiments, the support members 124 can be locked into position when the party table 100 is in the standing configuration and unlocked when a user desires to fold the party table 100 into the storage configuration. In alternate embodiments, the support members 124 can be selectively removable from the legs 104 and/or the tabletop 102.

The tabletop can comprise one or more bays 106. Each bay 106 can be an opening that extends at least partially through the tabletop 102. In some embodiments, the bays 106 can be apertures that extend completely through the tabletop 102. In alternate embodiments, the bays 102 can be depressions that are recessed into the tabletop 102. The walls that extend from the top of the bay 106 to the bottom of the bay 106 can be straight, tapered, angled, curved, or have any other shape or orientation.

In some embodiments, the bays 106 can be rectangular with rounded corners. In other embodiments, the bays 106 can be ovoid, rectangular, square, circular, triangular, L-shaped, be in the shape of an object, or have any other shape. In some embodiments, the tabletop 102 can comprise a plurality of bays 106 of the same shape and size. In alternate embodiments, the tabletop 102 can comprise multiple bays 106 of different shapes and/or sizes. In some embodiments in which the table segments 108 are selectively removable leaves, each table segment 108 can comprise one or more bays 106, such that a table segment 108 comprising a bay 106 that is not suitable for a particular application can be removed and replaced with a different table segment 108 comprising a bay 106 that is suitable for the particular application.

Figure 3:
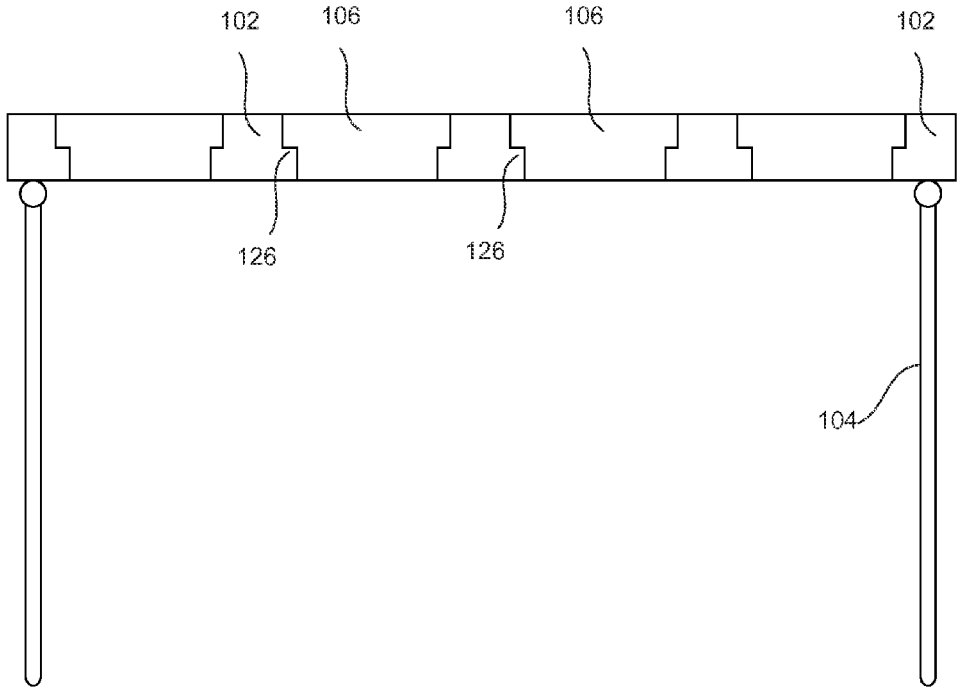
FIG. 3 depicts a cross section of an embodiment of a party table.

FIG. 3 depicts a cross section of an embodiment of the party table 100. Each bay 106 can comprise one or more braces 126 that extend at least partially into the bay 106. In some embodiments, the braces 126 can be extensions of the tabletop 102. In alternate embodiments, the braces 126 can be separate components that can be coupled with the underside of the tabletop 102 and/or the edge of a bay 106 via screws, nails, bolts, adhesives, interlocking components, friction fit, or any other attachment mechanism.

Figure 4:
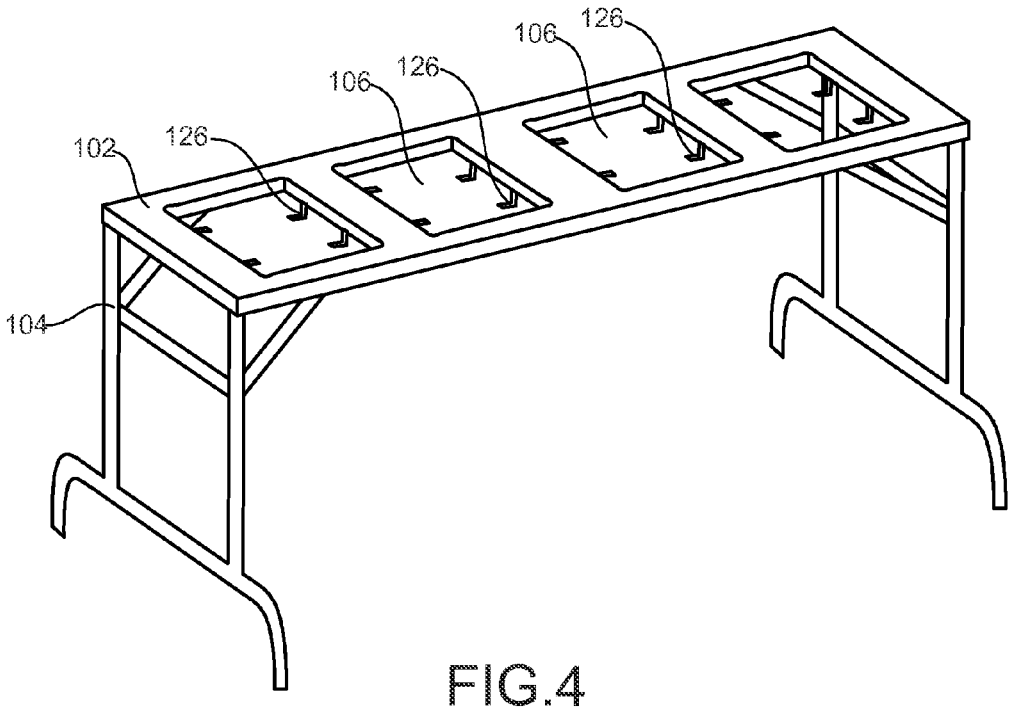
FIG. 4 depicts an isometric view of an embodiment of a party table with braces protruding partially into the bays.

In some embodiments, the braces 126 can be extensions and/or protrusions that partially extend into a bay 106. By way of a non-limiting example, a bay 106 can comprise a single brace 126 that extends from the underside of the tabletop 102 around the entirety of the bay 106, such that the brace 126 forms a ledge around the edges of the bay 106, as shown in FIG. 1. By way of another non-limiting example, the bays 106 shown in FIG. 4 each comprise braces 126 that partially extend into the bay 106 from four positions around the edge of the bay 106. In embodiments in which the braces 126 extend only partially into the bay 106, the braces 126 can be comprised of an inflexible material such as metal, plastic, wood, or any other strong and inflexible material or combination of materials.

Figure 5:
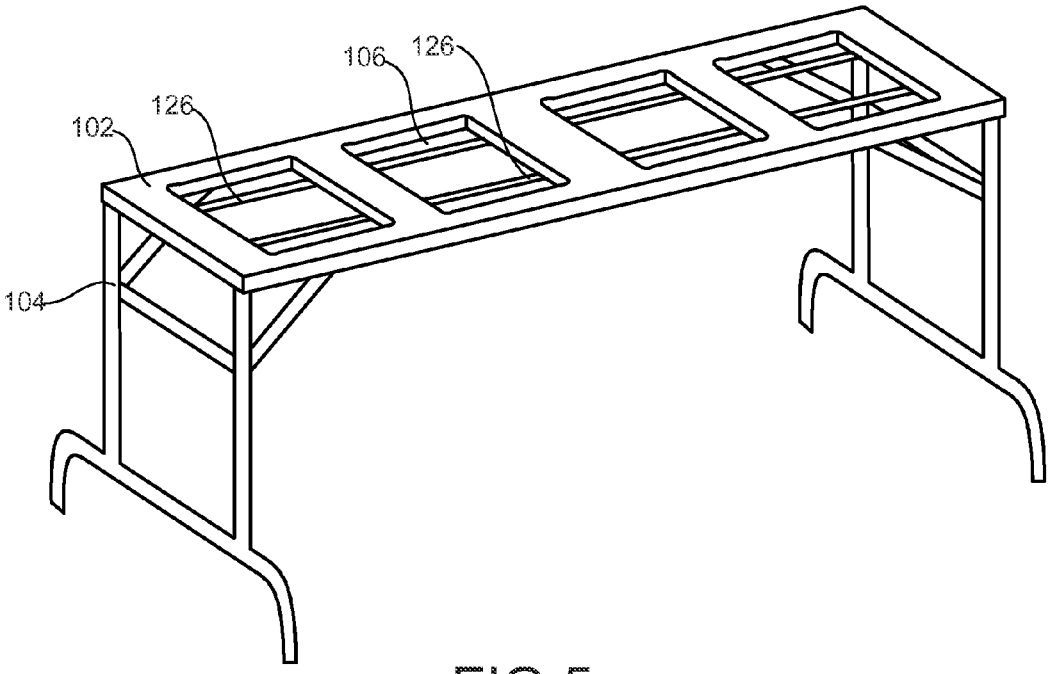
FIG. 5 depicts an isometric view of an embodiment of a party table with braces extending across the bays.

FIG. 5 depicts an isometric view of an embodiment of the party table 100 in which the braces 126 are elongated members that extend across the bay 106. In some embodiments, the braces 126 can be elongated members that extend from one point on an edge of the bay 106 to another point on an edge of the bay 106. By way of a non-limiting example, braces can be straps, crossbars, or netting that extend across a bay 106. In embodiments in which the braces 126 extend from one point on an edge of the bay 106 to another point on an edge of the bay 106, the braces 126 can be comprised of inflexible material and/or flexible material, such as metal, plastic, wood, fabric, rope, netting, webbing, or any other material or combination of materials.

Figure 6:
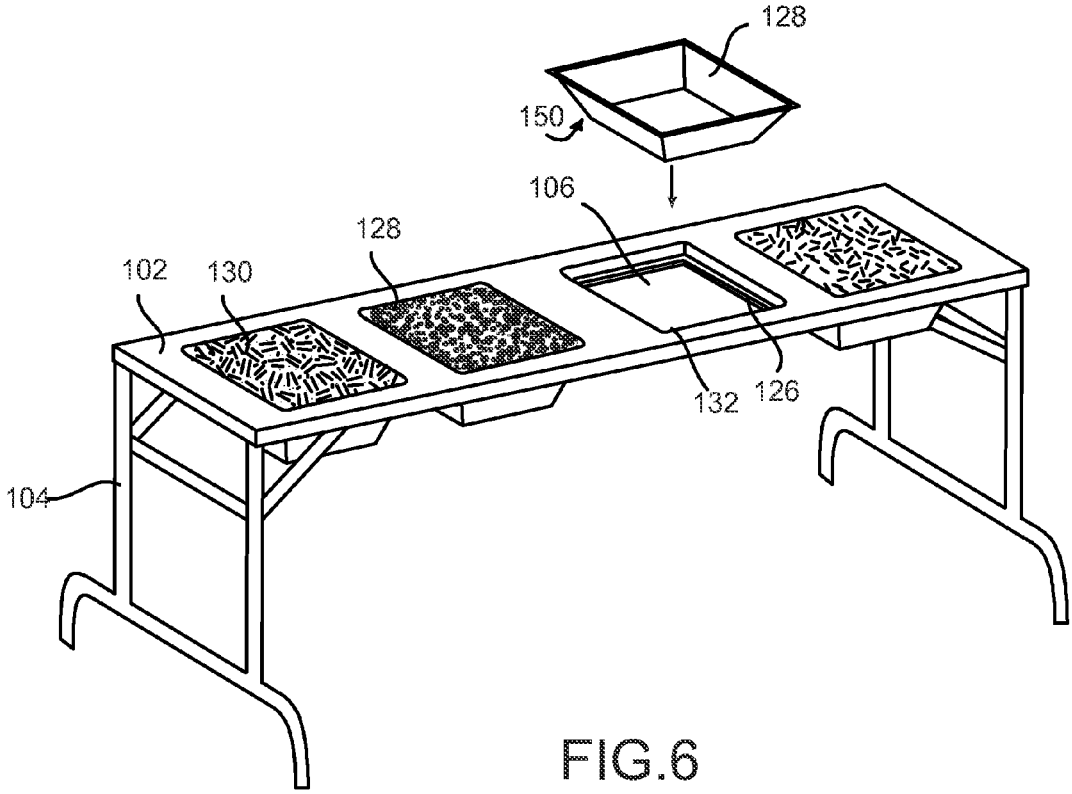
FIG. 6 depicts an isometric view of an embodiment of a party table with inserts.

FIG. 6 depicts an embodiment of the party table 100 in use with interchangeable inserts 128. The size and shape of each bay 106 and/or brace 126 can correspond with the size and shape of an insert 128, such that the insert 128 can be fit into the bay 106 and be supported by the braces 126 and/or the edges of the bay 106. In some embodiments, inserts 128 can be containers configured to hold and/or serve food items 130. Food items 130 can be any type of food and/or beverages. Each insert 128 can be a steam table pan, tray, pan, plate, dish, basket, serving dish, platter, vessel, cooler, bucket, tub, pot, bowl, carving board, or any other container designed to hold and/or serve food items 130. The bays 106 can accept any type of insert 128, such that the inserts 128 can be interchangeable and can be placed in any bay 106. Each insert 128 can have a shallow recess, a deep recess, be flat, or have any other shape or design depending on the operation of the insert 128 or the type of food item 130 stored within the insert 128. In some embodiments, the top of the insert 128 can be flush with the top side of the tabletop 102 when the insert is placed within a bay 106. In alternate embodiments, the top of the insert 128 can extend above the top side of the tabletop 102 when the insert 128 is placed within a bay 106.

In some embodiments, inserts 128 can be comprised of metal. In other embodiments, inserts 128 can be comprised of plastic, ceramic material, glass, wood, or any other desired material or combination of materials. In some embodiments, the inserts 128 can be made of or coated with a non-stick material such as polytetraflouroethylene or any other non-stick material. In some embodiments, the inserts 128 can be at least partially comprised of an insulating material such as foam, neoprene, gel, or any other insulating material.

In some embodiments, the edges of the bays 106 and/or the braces 126 can comprise a lining 132 configured to interact with an insert 128 that can be placed into the bay 106. In some embodiments, the lining 132 can be comprised of an insulating material, such as foam, rubber, neoprene, or any other insulating or heat-resistant material. In still other embodiments, the lining 132 can be a soft material, cushioning material, compressible material, or any other type of material or combination of materials.

Figure 7:
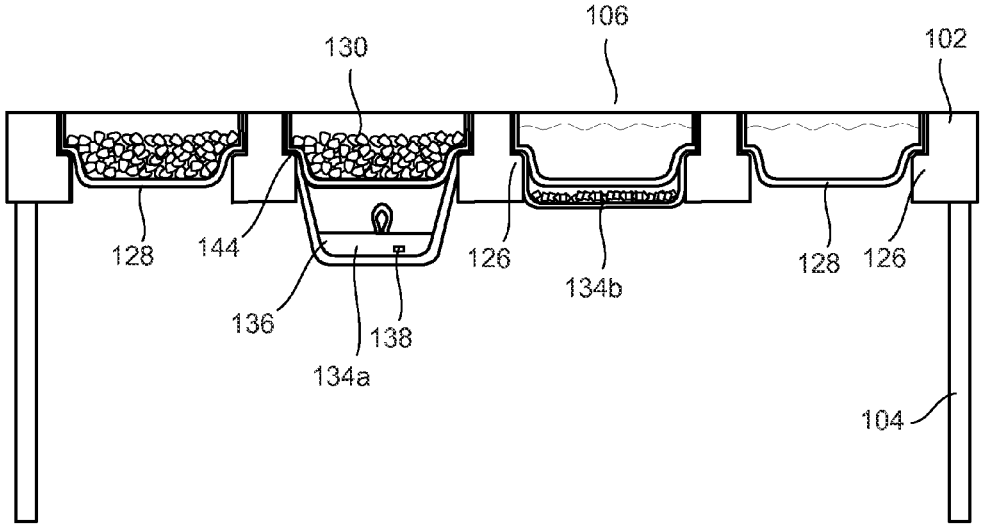
FIG. 7 depicts a cross section of an embodiment of a party table with insert attachments.

FIG. 7 depicts a cross section of one embodiment of the party table 100 with insert attachments 134. Insert attachments 134 can be configured to interact with one or more inserts 128 that are placed within the bays 106. In some embodiments, one or more insert attachments 134 can be placed within a bay 106 and be supported by the braces 126 and/or the edges of the bay 106, such that the insert attachments 134 can be below inserts 128 that are also placed within the bay 106. In other embodiments, the insert attachments 134 can be coupled directly with the inserts 128. In still other embodiments, the insert attachments 134 can be coupled with the tabletop 102 such that the insert attachment 134 hangs below one or more bays 106. In some embodiments in which the insert attachments 134 are coupled with the tabletop 102, the insert attachments 134 can be permanently coupled with the tabletop 102. In other embodiments in which the insert attachments 134 are coupled with the tabletop 102, the insert attachments 134 can be removably coupled with the tabletop 102.

Insert attachments 134 can be any item that can be required for service of food items 130. Insert attachments 134 can be used to cook, warm, freeze, cool, maintain, or regulate the temperature of food items 130. In some embodiments, an insert attachment 134 can be a heat generating apparatus, such as a heater, flame, fuel, steam table, grill, or any other heating or warming mechanism. By way of a non-limiting example, the insert attachment 134*a* depicted in FIG. 7 is a flame producing apparatus. In other embodiments, an insert attachment 134 can be a cooling apparatus, such as an ice tray, water bucket, cooler, or any other freezing or cooling mechanism. By way of a non-limiting example, the insert attachment 134*b* depicted in FIG. 7 is an ice tray. In some embodiments, the insert attachments 134 can be coupled with a power source 136, such as a fuel source, electrical outlet, electrical generator, battery, or any other mechanism for powering and operating the insert attachment 134. In some embodiments, controls 138 for operating the insert attachment 134 can be coupled with the tabletop 102, insert 128, and/or the insert attachment 134.

Figure 8:
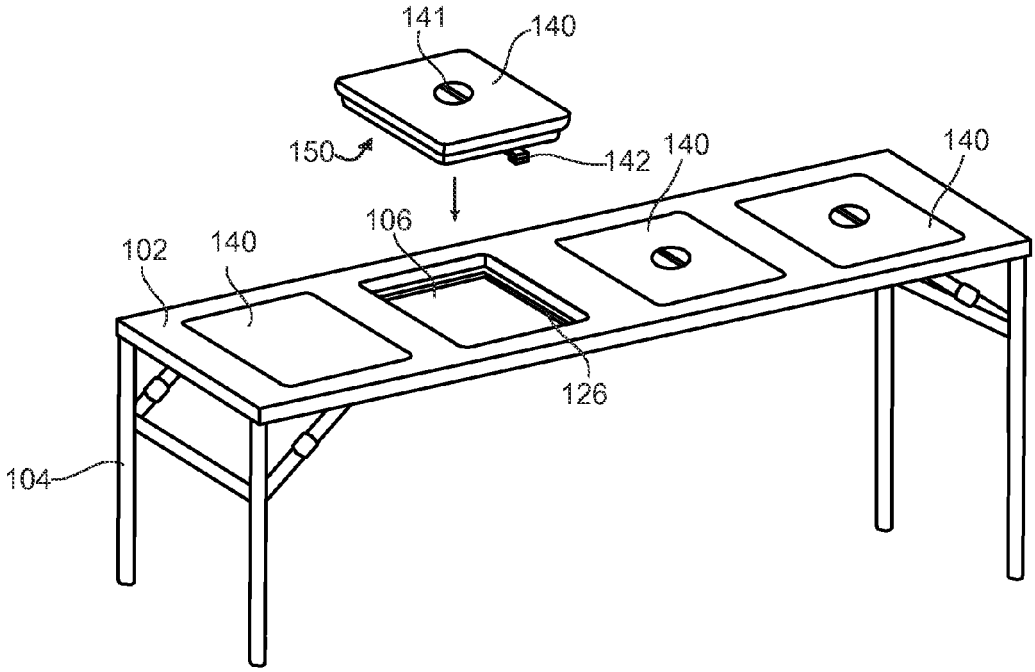
FIG. 8 depicts an isometric view of an embodiment of a party table with covers.

FIG. 8 depicts an embodiment of the party table 100 with covers 140. In some embodiments, a cover 140 can be placed into a bay 106. The cover 140 can be supported by the braces 126 and/or the edges of the bay 106. The size and shape of the covers 140 can correspond with the size and shape of the bays 106, such that the covers 140 can be fit into the bays 106. The cover 140 can have a substantially flat top side, such that the top of the cover 140 can be flush with the top side of the tabletop 102 when the cover 140 is placed within a bay 106. In some embodiments, the cover 140 can be comprised of the same material as the tabletop 102. In alternate embodiments, the cover 140 can be comprised of a different material than the tabletop 102. In some embodiments, the covers 140 can comprise a cover handle 141. The cover handle 141 can be flush with the top of the cover 140. In some embodiments, the cover handle 141 can be a crossbar spanning a depression recessed into the top of the cover 140. In alternate embodiments, the cover handle 141 can be housed in a depression recessed into the top of the cover 140 and the cover handle 141 can rotate upward from the top of the cover 140 when in use. In other embodiments, the cover handle 141 can be a depression, aperture, or any other type of handhold formed into or coupled with the cover 140. In some embodiments, the cover handle 141 can be absent.

Figure 9A:
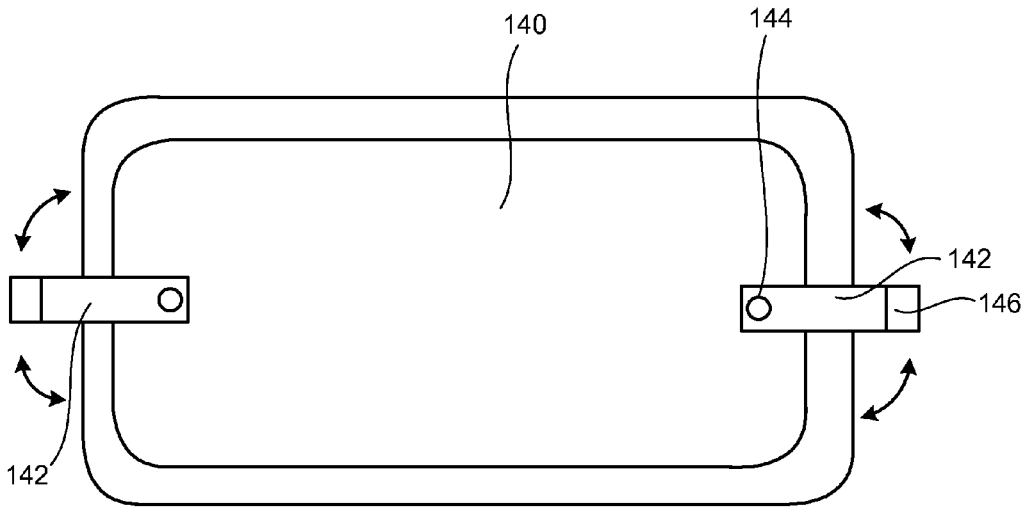
FIG. 9A depicts a bottom view of an embodiment of a cover.
Figure 9B:
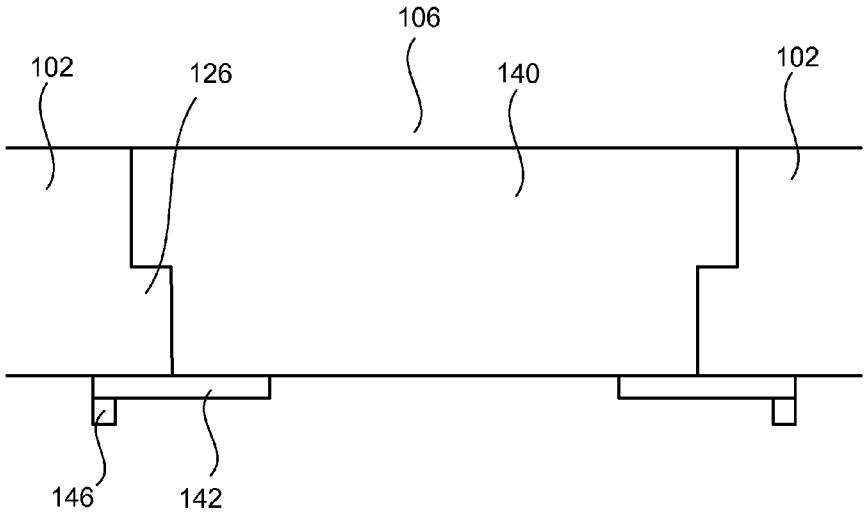
FIG. 9B depicts a close up cross section of an embodiment of the party table with a cover placed within a bay.

FIG. 9A depicts a bottom view of a cover 140, and FIG. 9B depicts a close up cross section of the tabletop 102 with a cover 140 placed within a bay 106. One or more levers 142 can be coupled with the cover 140. In some embodiments, a lever 142 can be coupled with each end of the cover 140. In some embodiments, the levers 142 can be coupled with the bottom of the cover 140 via a hinge 144. In operation, the levers 142 can rotate about the hinges 144 and latch beneath the tabletop 102 and/or a brace 126 to secure the covers 140 in position within the bays 106, as shown in FIG. 9B. In some embodiments, the lever 142 can comprise a lever handle 146. The lever handle 146 can be a protrusion extending out of the lever 142. In some embodiments, the lever 142 can be locked into position when the lever 142 is latched beneath the tabletop 102 and/or brace 126 and can be unlocked when a user desires to remove the cover 126 from the bay 106. In some embodiments, movement of the cover handle 141 can move the lever 142.

Figure 10:
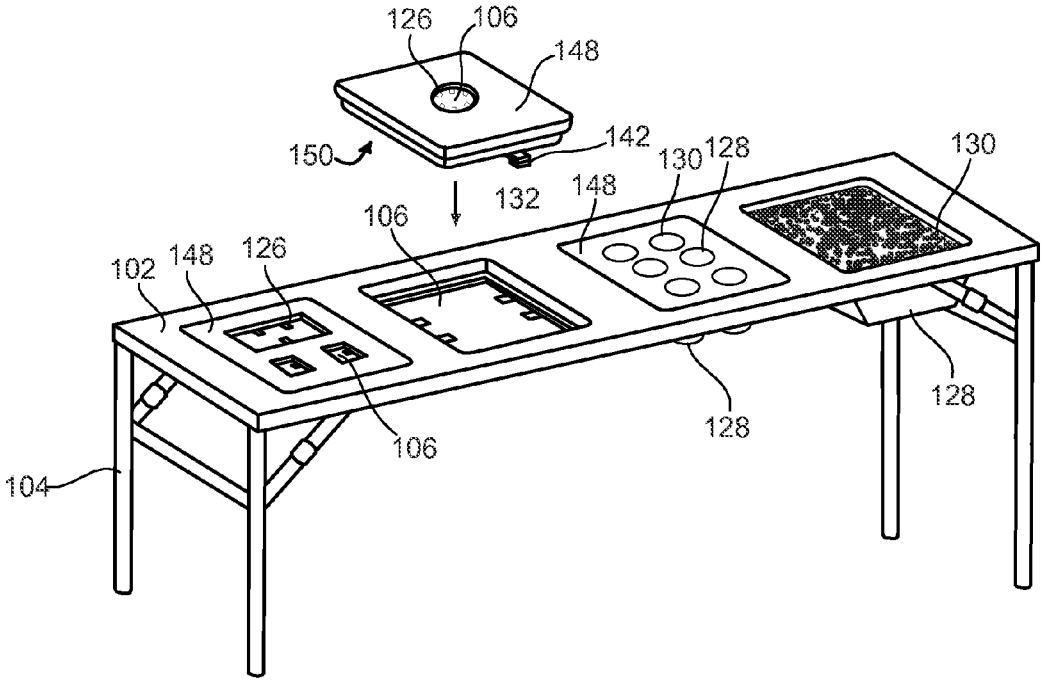
FIG. 10 depicts an isometric view of an embodiment of a party table with adapters.

FIG. 10 depicts an embodiment of the party table 100 with adapters 148. In some embodiments, an adapter 148 can be placed into a bay 106. The adapter 148 can be supported by the braces 126 and/or the edges of the bay 106. In some embodiments, the adapter 148 can comprise one or more levers 142 to latch the adapter 148 to the tabletop 102 as described in reference to FIGS. 9A and 9B. Each adapter 148 can comprise one or more smaller bays 106. In some embodiments, the smaller bays 106 can have the same shape as the bay 106 the adapter 148 is placed into. In other embodiments, the smaller bays 106 can have a different shape as the bay 106 the adapter 148 is placed into. The smaller bays 106 can comprise braces 126. In some embodiments, the adapter 148 can be comprised of the same material as the tabletop 102. In alternate embodiments, the adapter 148 can be comprised of a different material than the tabletop 102. In operation, an adapter 148 can be placed into a bay 106 such that an insert 128 that does not fit into a bay 106 in the tabletop 102 can be fit into a smaller bay 106 in the adapter 148.

In some embodiments, the braces 126 can interact with an insert 128, insert attachment 134, adapter 148, and/or cover 140 to secure the insert 128, insert attachment 134, adapter 148, and/or cover 140 in place once they have been placed within a bay 106. In some embodiments, each brace 126 can interact with a connection point 150 on the insert 128, insert attachment 134, adapter 148, and/or cover 140. Connection points 150 can be notches, indentations, locations, or any other feature that can interact with at least a portion of a brace 126. In some embodiments, the braces 126 can be movable relative to the tabletop 102 such that that the braces 126 can rotate, slide, extend, or otherwise move to interact with the connection points 150 on the insert 128, insert attachment 134, adapter 148, and/or cover 140. In other embodiments, the braces 126 can be in a fixed position relative to the tabletop 102 and can interact with the connection points 144 via friction fit, snaps, magnets, or any other attachment mechanism.

Accessories 152 can be selectively coupled with and/or used with the party table 100. Accessories 152 can be any device, tool, apparatus, or other item that can be used to cook, prepare, serve, or otherwise interact with food items 130, or be a container that can be configured to store or hold such items. By way of non-limiting examples, accessories 152 can be towel racks, paper towel racks, bottle openers, eating utensil holders, containers for dishware, lids that cover inserts 128, baskets, pot holders, serving spoon holders, racks, or any other item. In some embodiments, accessories 152 can be stored within inserts 128 placed within the bays 106. In other embodiments, the party table 100 can comprise one or more connectors 154 configured to selectively accept the accessories 152. Connectors 154 can be hooks, magnets, apertures, depressions, snaps, suction cups, or any other attachment mechanism. In some embodiments, the exterior edges of the tabletop 102 can comprise a plurality of connectors 154 capable of accepting any accessory 152 as desired. In other embodiments, the connectors 154 can be located at any position on the tabletop 102, legs 104, and/or support members 124.

Figure 11:
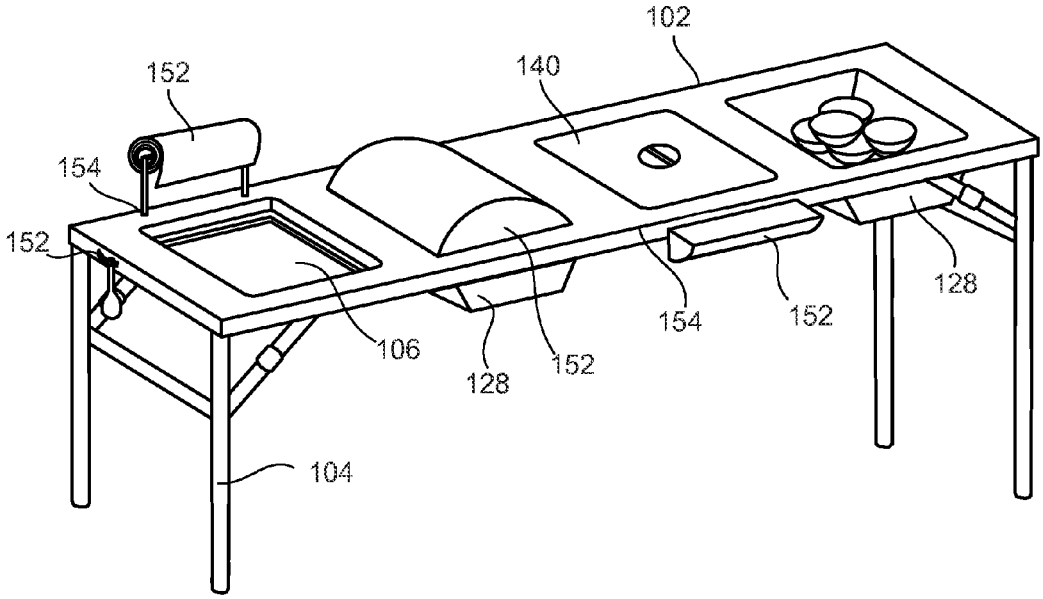
FIG. 11 depicts an isometric view of an embodiment of a party table with accessories.
Figure 12:
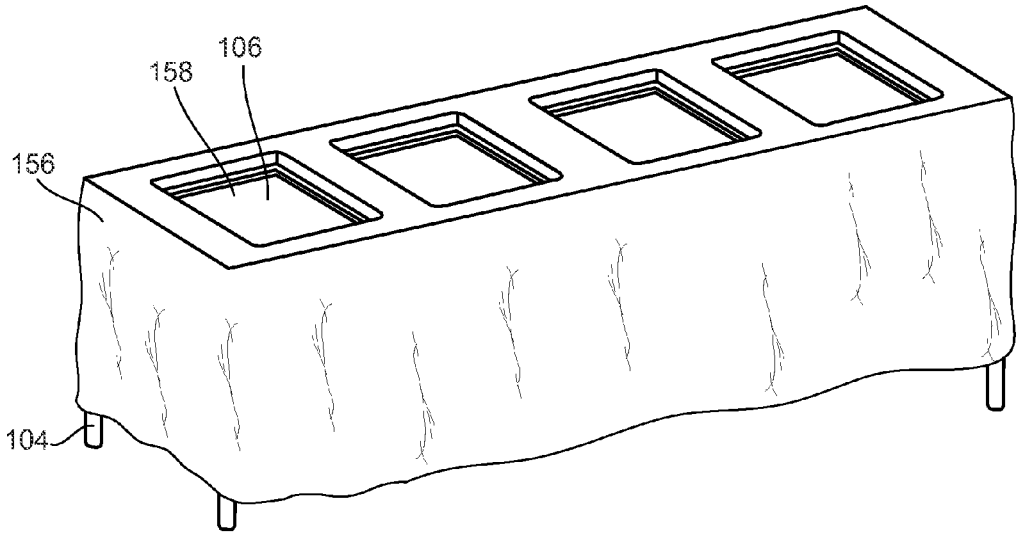
FIG. 12 depicts an isometric view of an embodiment of a party table with a table covering and/or skirt.

FIG. 11 depicts a party table 100 with a table covering 156. In some embodiments, a table covering 156 can be used with the party table 100. The table covering 156 can be a tablecloth, runner, mat, table skirt, or any other type of covering that can cover at least a portion of the tabletop 102 and/or cover the sides of the party table 100. The table covering 156 can have any length. In some embodiments, the table covering 156 can have a length such that the table covering 156 only covers the tabletop 102. In other embodiments, the table covering 156 can have a length such that the table covering 156 can reach the ground. In some embodiments, the table covering 156 can comprise openings 158 of the same size and shape as the bays 106, such that the bays 106 can be left open when the table covering 156 is in place on top of the tabletop 102. In some embodiments, the openings 158 can be flaps that can be opened to expose a bay 106. In alternate embodiments, the table covering 156 can be a table skirt that can leave the top of the tabletop 102 exposed while extending from the sides of the tabletop 102 towards the ground. In some embodiments, the table covering 158 can be selectively coupled with the party table 100 through the use of snaps, hook and loop fasteners, magnets, or any other attachment mechanism. In alternate embodiments, the table covering 156 can be placed on top of the party table 100 and arranged in position.

In operation, the party table 100 can be transported to a desired location and the legs 104 and/or tabletop 102 can be unfolded or assembled such that the party table 100 is in the standing position. In some embodiments the legs 104 and/or tabletop 102 can be locked to ensure that the party table 100 remains in the standing position. A selection of insert attachments 134, adapters 148, and/or covers 140 can be placed within the bays 106 to create a party table 100 with a configuration of bays 106 suitable for the particular application with which it is to be used. Accessories 152 can be coupled with the party table as desired. Food items 130 can be prepared in a kitchen, factory, or other location and be placed within the inserts 128. The inserts 128 can be transported to the party table 100 and placed within a bay 106 such that the food items 130 can be served. If necessary, the food items 130 in the inserts 128 can be warmed, cooled, or have their temperature regulated by the insert attachments 134. In alternate embodiments, the food items 130 can be cooked within an insert 128 at the party table 100 through the use of an insert attachment 134. When the food items 130 within an insert 128 have been served and/or a user desires to replace an insert 128, the insert 128 can be removed from the bay 106 and replaced with a different insert 128 that contains different food items 130 or fresh servings of the same food items 130, similar to the operation of a buffet. In some embodiments, a plurality of party tables 100 can be used that is suitable for the number and type of food items 130 to be served and/or the number of people to be served. In embodiments in which multiple party tables 100 are used, each party table 100 can have its own configuration of inserts 128, insert attachments 134, adapters 148, covers 140, and/or accessories 152.

When a user desires to store or transport the party table 100, the inserts 128, insert attachments 134, adapters 148, covers 140 and/or accessories 152 can be removed from the bays 106 and be stored or transported separately. The legs 104, the support members 124, and/or the tabletop 102 can then be folded, detached, and/or manipulated to convert the party table 100 from the standing configuration to the storage configuration. In alternate embodiments, the party table 100 can be folded in a configuration such that inserts 128, insert attachments 134, adapters 148, and/or covers 140 can remain in place within the bays 106. In still other embodiments, the inserts 128, insert attachments 134, adapters 148, and/or covers 140 can be placed within the bays 106 upside down such that they extend upward from the top side of the tabletop 106, so that the legs 104 can fold underneath the tabletop 102 without impacting the inserts 128, insert attachments 134, adapters 148, and/or covers 140.

In the foregoing specification, the invention has been described with reference to specific exemplary embodiments thereof. It will, however, be evident that various modifications and changes can be made thereto without departing from the broader spirit and scope of the invention. The specification and drawing are, accordingly, to be regarded in an illustrative sense rather than in a restrictive sense.

What is claimed is:

1. A party table, comprising:

a tabletop defining a plurality of bays, each of said plurality of bays being an aperture that extends entirely through said tabletop;

one or more legs coupled directly to said tabletop;

one or more inserts, each said insert being configured to be placed into one of said plurality of bays such that said insert extends through said one of said plurality of bays beneath the lower surface of said tabletop; and one or more insert attachments, each said insert attachment being configured to be placed into one of said plurality of bays, such that said insert attachment hangs below one of said inserts placed into the same one of said plurality of bays;

wherein said tabletop and said legs can be moved between a standing configuration and a storage configuration;

wherein at least one of said insert attachments is a heating element configured to selectively heat one of said inserts placed into the same one of said plurality of bays above said heating element.

2. The party table of claim 1, wherein at least one of said inserts is a food service pan.

3. The party table of claim 1, further comprising one or more support members each coupled with one of said legs and said tabletop, each of said one or more support members extending between one of said legs and the underside of said tabletop at an angle.

4. The party table of claim 1, wherein said plurality of bays each comprise one or more braces that extend at least partially into an interior of one of said plurality of bays.

5. The party table of claim 4, wherein said one or more braces are configured to provide support to one of said one or more inserts when said one of said one or more inserts is placed into one of said plurality of bays.

6. The party table of claim 1, wherein said legs further comprise wheels.

7. The party table of claim 1, wherein said tabletop further comprises one or more table segments.

8. The party table of claim 7, wherein said table segments are hingeably coupled with one another.

9. The party table of claim 1, wherein said legs are hingeably coupled with said tabletop.

10. The party table of claim 1, further comprising one or more handles coupled with said tabletop.

11. The party table of claim 1, further comprising:

one or more adapters each capable of being placed into one of said plurality of bays;

wherein each of said one or more adapters comprises one or more smaller bays.

12. The party table of claim 1, further comprising one or more covers each capable of being placed into one of said plurality of bays.

13. The party table of claim 1, wherein at least one of said insert attachments is a cooling element configured to cool one of said inserts placed into the same one of said plurality of bays above said cooling element.

14. The party table of claim 1, further comprising one or more food service accessories.

15. The party table of claim 1, further comprising:

a table covering coupled with said tabletop, wherein said table covering comprises a plurality of openings configured to be placed over said plurality of bays.

16. The party table of claim 1, further comprising a table skirt.

17. The party table of claim 1, wherein at least one of said inserts is a cooler.

* * * * *